OR 4,072,936

T 340-566

United Stat

Spirig

[1] 4,072,936

[5] Feb. 7, 1978

[54] METHOD OF AND APPARATUS FOR DETECTING DAMAGE TO A FRANGIBLE OBJECT

[76] Inventor: Ernst Spirig, Movenstrasse 37, CH-8640 Rapperswil, Switzerland

[21] Appl. No.: 767,941

[22] Filed: Feb. 11, 1977

[30] Foreign Application Priority Data

Sept. 9, 1976 Switzerland ..... 11466/76

[51] Int. Cl.[2] ..... G08B 13/04

[52] U.S. Cl. ..... 340/274 R; 340/261

[58] Field of Search ..... 340/274 R, 261

[56] References Cited

U.S. PATENT DOCUMENTS 3,618,062 11/1971 Ott ..... 340/261

3,863,250 1/1975 McCluskey, Jr. ..... 340/261

3,889,250 6/1975 Solomon ..... 340/261

*Primary Examiner*—Glen R. Swann, III

*Attorney, Agent, or Firm*—Lawrence E. Laubscher

[57] ABSTRACT

Damage to a frangible article, particularly a glass window is detected by sensors responsive to oscillations in different frequency bands. Only when all the sensors are simultaneously responsive is an alarm signal, denotive of damage to the article, developed. Piezo-ceramic transducers respond to frequencies within the range of 30 kHz to 1 MHz. The sensors are connected in parallel with inductors to provide resonant amplification of the voltage developed. The resultant signals are amplified and applied to an AND gate yielding the required output signal.

12 Claims, 5 Drawing Figures

METHOD OF AND APPARATUS FOR DETECTING DAMAGE TO A FRANGIBLE OBJECT

BACKGROUND OF THE INVENTION

1. Field of the Invention

The present invention relates to a method of detecting the oscillations which occur when an object, more particularly a glass plate, is damaged, in which method the oscillations are converted by sensors into electrical signals at frequencies lying within a definite frequency band, the sensor signals being processed in order to generate a warning signal, and to apparatus for carrying out this method with sensors for transforming the oscillations into electrical signals and a circuit arrangement to which the sensors are connected and which generates a warning signal in dependence on the oscillations which occur.

2. Description of the Prior Art

It is known, for example from German Pat. No. 2127562, that oscillations lying in the supersonic wave-range occur when glass plates are broken or cut, while oscillations caused by environmental disturbances (for example when the glass plate undergoes shocks, knocks, etc.) comprise comparatively low frequencies of below about 100 kHz.

This is the basis of known devices for detecting damage to glass plates, which detect frequencies of oscillation above about 100 kHz and process them to yield corresponding warning or tripping signals. Such a device is known for example from German Pat. No. 2260352, in which piezo-electric transducers are cemented to the glass plate to be monitored. The output signals of these transducers are transmitted via screened cables or by radio to an evaluator circuit. This evaluator circuit evaluates the signals received from the sensors. Now in order to avoid false alarms caused by environmental effects, such as shocks, knocks, etc., this evaluation must take place in a complex fashion. For this reason, the evaluator circuit is of relatively complicated construction, which makes production and installation time-consuming and correspondingly expensive.

This disadvantage is eliminated in the case of the device described in German Pat. No. 2254540. The sensor takes the form of a freely oscillating piezo element, of which the characteristic frequency lies in the supersonic range to be monitored. The piezo element converts the oscillations which it receives into electrical signals, which are evaluated in a circuit accommodated in the same housing as the piezo element. According to the "goodness" of the piezo element, oscillations at frequencies lying in a more or less wide frequency band are now detected and evaluated. In the case of this last-named device, the circuit and appliance are considerably less technically complex than in the case of the device according to German Pat. No. 2260352, but as a result increased liability to false alarms must be expected since it is not possible with this freely oscillating piezo element to distinguish sufficiently clearly between oscillations generated by environmental effects and oscillations caused by cutting or breaking the glass plate.

SUMMARY OF THE INVENTION

The purpose of the present invention is to overcome the disadvantages of the known processes and devices described above. The problem to be solved by the invention is thus to provide a method and apparatus, which enable damage to the object to be protected, more particularly a glass plate, to be simply and reliably detected, without false warnings being caused by environmental effects.

It is an object of the invention to provide a method of detecting damage to a frangible object which will permit discrimination against responses due to vibration or shock.

It is a further object of the invention to provide an apparatus for detecting damage to a frangible object that is less complex than some prior art apparatuses for this purpose.

It is a more specific object of the invention to provide a method of detecting damage to a frangible object in which a plurality of vibration sensors, each responsive to vibrations, generated within the object, lying in a different respective frequency band, are attached to the object and are connected to an evaluating means yielding an alarm signal only when all of the sensors respond simultaneously.

Correspondingly it is also an object of the invention to provide apparatus for detecting breakage of a frangible object, that includes a plurality of vibration sensors, each responsive to vibrations within a different respective frequency range, are attached to the frangible object and are coupled with an evaluating circuit means arranged to yield an alarm signal only when all of the plurality of sensors respond simultaneously to vibrations in the respective different frequency range.

DESCRIPTION OF THE PREFERRED EMBODIMENT

Figure 1:
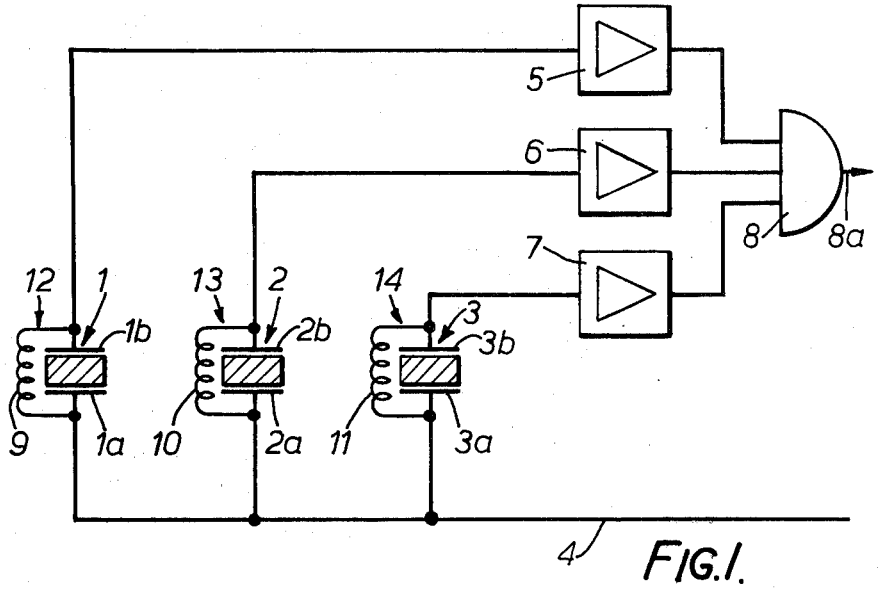
FIG. 1 shows the circuit diagram of a first example of embodiment of a device for detecting damage to a glass plate.
Figure 2:
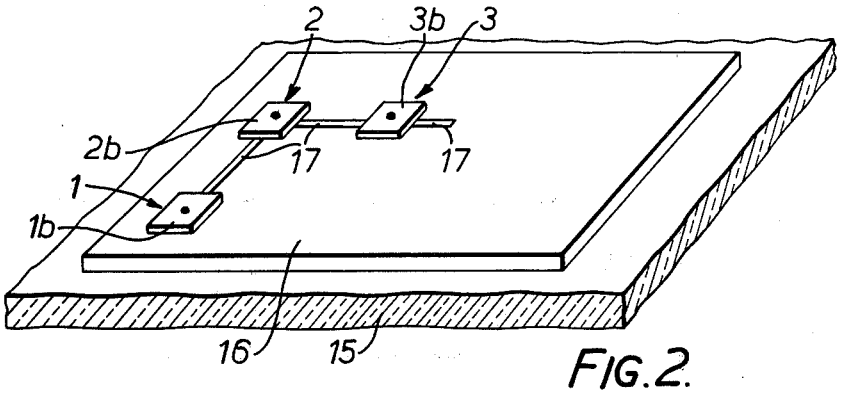
FIG. 2 shows diagrammatically and in plan view components of the device according to FIG. 1 cemented to a glass plate.
Figure 3:
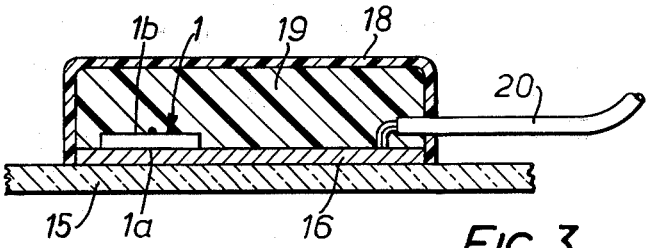
FIG. 3 shows in section the components of the device according to FIG. 1 accommodated in a housing.

A first example of embodiment of a device for detecting damage to a frangible object, here assumed to be a glass plate, is diagrammatically illustrated in FIGS. 1 – 3 of the drawings. As the circuit diagram according to FIG. 1 shows, there are for example three piezo-electric transducers 1, 2 and 3 of piezo-ceramic material. Each of these piezo-electric elements 1, 2, 3 possesses a different characteristic frequency, so that each piezo-electric element responds to oscillations of which the frequencies lie in a different respective frequency band. These frequency bands preferably lie in the frequency band of approx. 30 kHz to approx. 1 MHz.

One electrode *1a*, *2a*, *3a* of the piezo-electric elements 1, 2, 3 is connected to a common connection 4. The other electrode *1b*, *2b*, *3b* of each piezo-electric element 1, 2, 3 is connected to a threshold-value circuit 5, 6 or 7 comprising respective amplifying elements. The amplified outputs of the threshold-value circuits 5, 6, 7 are connected to the inputs of an AND circuit 8. A respective inductance 9, 10 or 11 is connected in parallel with each piezo-electric element 1, 2, 3. The capacity of the piezo-electric elements 1, 2, 3 and this inductance 9, 10, 11 constitute a resonant circuit 12, 13 or 14 with a definite goodness factor. These resonant circuits 12, 13, 14 produce an increase in effective transducer voltage. As a result, less amplification of the output signal of these resonant circuits is required in the threshold-value circuits 5, 6, 7.

When the glass plate or other frangible object being monitored is cut or broken, oscillations appear as mentioned in the supersonic range, and are converted into electrical signals by the piezo-electric elements 1, 2, 3. The signals generated in the resonant circuits 12, 13 and 14 are fed to the associated threshold-value circuits 5, 6 or 7. Now if the input signal to these threshold-value circuits exceeds a certain lower threshold value, this signal is amplified and applied to an input of the AND circuit 8. Now if all the inputs of the AND circuit 8 are thus energized, an output signal appears at its output 8*a*, and is passed on in the form of a warning signal to an alarm-initiating device known per se which is not more precisely illustrated, and which trips an alarm. It is preferable to use an ANd circuit 8 with a low-impedance output, so that there is no need to use screened leads in order to pass on the output signal to the alarm-initiating device.

If all the piezo-electric elements 1, 2, 3 do not respond, or if the output signals of the resonant circuits 12, 13, 14 do not reach the lower threshold value mentioned, no output signal is generated by the AND circuit 8, and thus no alarm is tripped.

According to the type and thickness of the glass and to the kind of damage, the amplitudes of oscillation are intensified in certain frequency ranges.

Now if the part frequency bands to be monitored by the individual piezo-electric elements 1, 2, 3 are so chosen that they coincide with these frequency ranges mentioned, only damage to the glass plate is detected. False indications generated by environmental effects are thus avoided.

In the case of the form of embodiment described above, the result of using piezo-electric elements 1, 2, 3 of differing characteristic frequency is that each piezo-electric element monitors its own frequency band. However, it is also possible to choose piezo-electric elements 1, 2, 3 with the same characteristic frequency, and by suitably choosing the inductances 9, 10 and 11 to ensure that the resonant circuits 12, 13, 14 have different resonant frequencies characteristic of the respective frequency bands. This ensures that the resonant circuits 12, 13, 14 respond to oscillations in these different frequency bands.

The construction of the device according to FIG. 1 is shown in FIGS. 2 and 3, but not all the components are illustrated. A ceramic plate 16 is cemented to the glass plate 15 to be monitored. Conductive strips 17 and mutually electrically connected contact surfaces are formed on this ceramic board 16 by means of known methods used in producing thick-film circuits. Three piezo-electric elements 1, 2, 3 are soldered by way of their lower electrodes 1*a*, 2*a*, 3*a* to the corresponding contact surfaces on the ceramic plate 16. The circuit elements as shown in FIG. 1 may now be formed on the remainder of the surface of the ceramic plate 16 by the thick-film circuit art. These circuit elements are not shown in FIGS. 2 and 3. The ceramic plate 16 and the circuit elements arranged thereon are accommodated in a housing 18 (FIG. 3), which may be filled with an encapsulating composition 19. The connecting cable 20 with the leads to the alarm-tripping device is passed through the wall of the housing.

However, it is also possible to use a printed circuit instead of the thick-film circuit described. All the piezo-electric elements together with the associated circuit elements are thus accommodated in a housing which is fastened to the glass plate 15 by means of a suitable cement.

Figure 4:
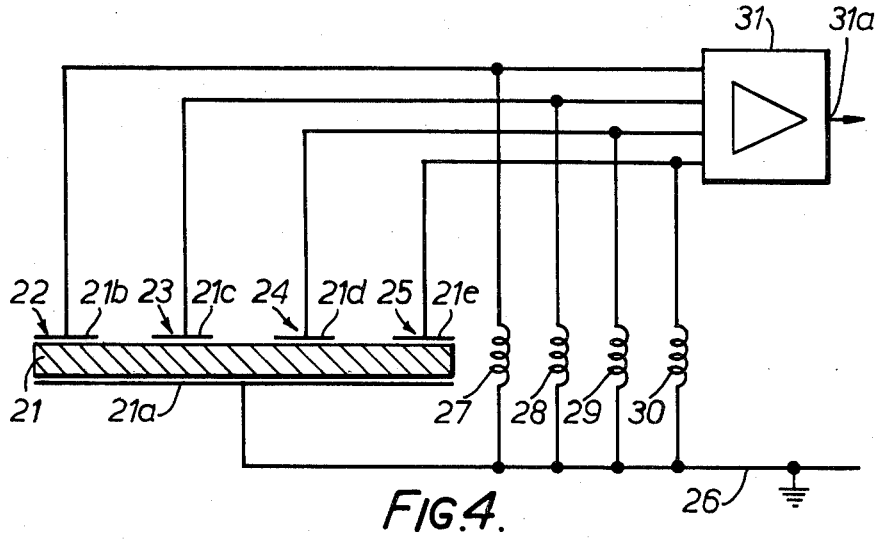
FIG. 4 shows the circuit diagram of a second example of embodiment of a device for detecting damage to a glass plate.
Figure 5:
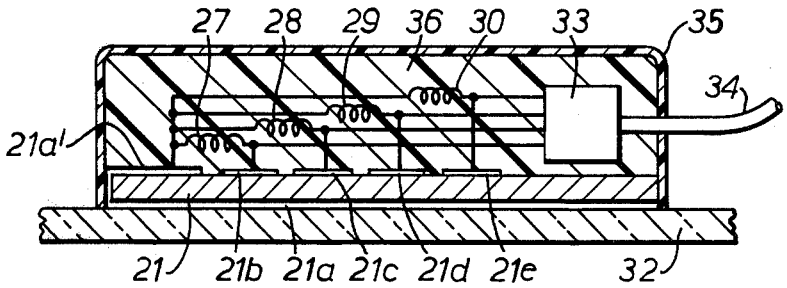
FIG. 5 shows in section components of the device according to FIG. 4 incorporated in a housing and cemented to a glass plate.

A second embodiment of apparatus for detecting damage to a glass plate is shown in FIGS. 4 and 5. The circuit according to FIG. 4 corresponds essentially to the circuit diagram according to FIG. 1. Instead of a plurality of individual piezo-electric elements 1, 2, 3, as shown in FIG. 1, the embodiment according to FIGS. 4 and 5 uses a single piezo-electric member 21 of piezoceramic material comprising a single lower electrode 21*a* and a plurality, in the present case four, of upper electrodes 21*b*, 21*c*, 21*d* and 21*e*. The lower electrode 21*a* is a common electrode, between which and the individual upper electrodes 21*b* – 21*e* are formed different piezo-electric elements 22, 23, 24 and 25. The ceramic board 16 shown in FIGS. 2 and 3 is omitted in this second form of embodiment.

The common electrodes 21*a* is joined to a connection 26. Between the lower electrode 21*a* and each upper electrode 21*b* 14 21*e*, a respective inductance 27, 28, 29 or 30 is connected in parallel with each piezo-electric element 22 – 25. As already described with reference to FIG. 1, each piezo-electric element 22 – 25 and the respective parallel-connected inductance 27 – 30 constitutes a resonant circuit. These resonant circuits act in the same manner as the resonant circuits 12 – 14 of FIG. 1. The outputs of the resonant circuits are connected to the inputs of a circuit 31. This circuit 31 functions in a corresponding manner to the combination of the threshold-value circuits 5, 6, 7 and the AND circuit 8 of FIG. 1. This circuit 31 accordingly contains a threshold-value circuit with an amplifying portion and an ANd member. The threshold values can be individually set for each input.

The manner of operation of the device according to FIG. 4 is the same as that of the device according to FIG. 1. The circuit 31 generates a warning signal at its output 31*a* only when input signals exceeding the lower threshold values associated with the individual inputs are present at all the inputs. Each of the resonant circuits 22, 27; 23, 28; 24, 29 and 25, 30 exhibits a different respective resonant frequency, which may be achieved, as already explained with reference to FIG. 1, as a result of the fact that the electrical values of the inductance 27 – 30 and/or of the piezo-electric elements 22 – 25 are chosen to be correspondingly different. Each of these resonant circuits also serves in the case of this example of embodiment to monitor a respective frequency band.

The construction of the device according to FIG. 4 is diagrammatically shown in section in FIG. 5. The lower electrode 21*a* is cemented directly to the glass plate 32 to be monitored. In order to make it easier to connect this lower electrode 21*a* electrically to the remaining components of the device, this electrode 21*a* is led by way of a portion 21*a*′ on to the top of the piezoelectric member 21. The circuit 31 and any further electronic components which may be required are combined to form a monolithic complex integrated semiconductor circuit 33. The electrical linking lead to the alarm-tripping device, which is not shown, is designated by 34. All the components are accommodated in a housing 35 whereof the interior may be filled with a poured composition 36.

The lower electrode 21*a* is preferably electrically earthed in order to provide screening from desired and undesired electrical interference from the plate side caused in order to put the device out of operation.

The glass-breakage warning systems are advanageously fitted to the protected inside of the plate, so that sabotage would have to be carried out through the glass.

The apparatus described is especially suitable for detect-damage to glass plates. However, it is also possible to use this device for detecting breakage of solid bodies, for example, of ceramic material.

The number of vibration transducers (piezoelectric elements) may be chosen as desired, and is determined according to how many different frequency bands result from a required subdivision of the frequency range of about 30 kHz to about 1 MHz to be monitored.

What is claimed is:

1. The method of detecting breakage of a frangible object which comprises detecting ultrasonic oscillations occurring in said object in each of a plurality of mutually distinct frequency ranges, and developing a signal denotive of said breakage when oscillations are detected simultaneously in all said frequency ranges.

2. The method claimed in claim 1 wherein said ultrasonic oscillations lying in mutually distinct bands in the frequency range of 30 kHz to 1MHz are detected.

3. The method claimed in claim 1 wherein oscillations in each of said mutually distinct frequency ranges are detected by means of a piezo-electric vibration transducer shunted by an inductor.

4. Apparatus for detecting breakage of a frangible object, comprising a plurality of ultrasonic transducers coupled to said object to respond to ultrasonic vibrations in different respective frequency ranges occurring therein, circuit means yielding a breakage-denotive output signal in response to the simultaneous application of signals to a plurality of inputs thereof and means applying the signal from each said transducer to a respective input of said circuit means whereby said breakage-denotive output signal is developed.

5. Apparatus as claimed in claim 4 wherein said ultrasonic transducers are piezo-electric elements.

6. Apparatus as claimed in claim 5 wherein a respective inductor is electrically connected in parallel with each said piezo-electric element.

7. Apparatus as claimed in claim 6 wherein all of said transducers possess the same natural response frequency and wherein said inductors are chosen so that each parallel combination of a said piezo-electric element and the respective inductor is resonant at a respective different frequency.

8. Apparatus as claimed in claim 4 wherein said circuit means comprises respective threshold means, each said threshold means yielding an output signal only when an individual transducer signal applied thereto exceeds a respective threshold level and AND circuit means responsive to said threshold means output signals to yield said breakage-denotive output signal only when all of said threshold means simultaneously yield said output signals.

9. Apparatus as claimed in claim 5 wherein a plurality of said piezo-electric elements are constituted by respective portions of a single body of piezo-electric material.

10. Apparatus as claimed in claim 9 wherein said body of piezo-electric material has thereon a first electrode common to all said transducers and further electrodes each individual to a respective one of said transducers.

11. Apparatus as claimed in claim 5 wherein each of said piezo-electric elements comprises a member of piezo-electric material having electrodes applied thereto and is secured by one of said electrodes to a common substrate.

12. Apparatus as claimed in claim 4 wherein all of said transducers and said circuit means are secured to a common substrate enclosed within a housing filled with encapsulating material.

* * * * *